US007704922B2

(12) United States Patent
Suzuki et al.

(10) Patent No.: US 7,704,922 B2
(45) Date of Patent: Apr. 27, 2010

(54) THERMAL TRANSFER IMAGE-RECEIVING SHEET

(75) Inventors: Masamitsu Suzuki, Tokyo (JP); Mitsuru Maeda, Tokyo (JP); Masahiro Yuki, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 1180 days.

(21) Appl. No.: 11/092,637

(22) Filed: Mar. 30, 2005

(65) Prior Publication Data

US 2005/0221983 A1 Oct. 6, 2005

(30) Foreign Application Priority Data

Mar. 31, 2004 (JP) ..... 2004-104998
Mar. 31, 2004 (JP) ..... 2004-105007

(51) Int. Cl.
*B41M 5/20* (2006.01)
*B41M 5/24* (2006.01)

(52) U.S. Cl. ..... 503/227; 428/32.39; 428/32.5; 428/32.51; 428/32.52

(58) Field of Classification Search ..... 428/32.39, 428/32.5, 32.51, 32.52; 503/227
See application file for complete search history.

(56) References Cited

U.S. PATENT DOCUMENTS 4,820,687 A 4/1989 Kawasaki et al.
5,278,130 A * 1/1994 Arita et al. ..... 503/227
5,332,712 A * 7/1994 Shinohara et al. ..... 503/227
5,525,573 A * 6/1996 Uemura et al. ..... 503/227
5,824,760 A 10/1998 Tamura et al.
2002/0108702 A1* 8/2002 Ueno et al. ..... 156/227
2009/0022911 A1* 1/2009 Suzuki et al. ..... 428/32.6

FOREIGN PATENT DOCUMENTS

EP 0 705 711 A 10/1996
JP 01-247196 A 10/1989
JP 07-149061 A 6/1995
JP 8-108636 A 4/1996
JP 09-329896 A 12/1997
JP 11-034513 A 2/1999
JP 2002-264543 A 9/2002

OTHER PUBLICATIONS

Sep. 1, 2009 Office Action in counterpart application 2004-105007.
Sep. 1, 2009 Office Action in counterpart application 2004-104998.

* cited by examiner

*Primary Examiner*—Jennifer McNeil
*Assistant Examiner*—David J Joy
(74) *Attorney, Agent, or Firm*—Birch, Stewart, Kolasch & Birch, LLP

(57) ABSTRACT

A thermal transfer image-receiving sheet which comprises a substrate sheet and a receiving layer comprising a polyester resin provided on at least one surface of the substrate sheet, wherein the receiving layer is a layer formed by applying a coating solution comprising 1 to 3% by weight of a modified silicone oil (I) modified with both groups of an aminoalkyl group and a polyalkylene ether group, and 0.1 to 4.0% by weight of a curing agent based on 100 parts by weight of the polyester resin, and drying the solution, 0.2 to 3% by weight of a polyether-modified silicone oil (II) and/or phenol-modified silicone oil (III) being contained in the coating solution, if desired.

11 Claims, No Drawings

THERMAL TRANSFER IMAGE-RECEIVING SHEET

RELATED APPLICATIONS

The present application claims priority under 35 USC § 119 (a)-(d) of Japanese application 2004-105007, filed on Mar. 31, 2004 and Japanese application 2004-104998, filed on Mar. 31, 2004.

BACKGROUND OF THE INVENTION

1. Field of the Invention

The present invention relates to thermal transfer image-receiving sheets which are used in superposition on thermal transfer sheets.

2. Description of the Related Art

As an image-forming method utilizing a thermal transferring process, a method called "sublimation-type thermal transfer system" is known in which a thermal transfer sheet comprising a substrate sheet such as paper and a plastic film supporting thereon a sublimable dye as a recording material and a thermal transfer image-receiving sheet comprising paper or a plastic film having thereon a layer for receiving the dye are superposed on each other so that a full-color image is formed. Because of use of a sublimable dye as a color material, this method can adjust the density and the tone freely by dot so that it is possible to clearly form a full-color image faithful to an original document on an image-receiving sheet. This method is therefore applied to color image formation in digital cameras, videos, computers and the like. The resulting images are of a high quality comparable to silver salt photographs.

The images to be formed by printing by means of the sublimation-type thermal transfer system are required to have a high image quality and also a light resistance comparable to that of silver salt photographs. A major approach for achieving such light resistance is to print yellow, magenta and cyan on a thermal transfer image-receiving sheet, followed by lamination of a protective layer thereon.

On the other hand, with respect to a binder for use in thermal transfer sheets, acetal-based resin has been mainly used. In such a case, use of a polyester-based resin in a receiving layer causes a problem in that it is difficult to secure a proper releasability between a thermal transfer sheet and an image-receiving sheet because the acetal-based resin and the polyester-based resin are liable to be thermally fused during printing.

In order to secure a sufficient releasability, techniques in which a large amount of releasing agent such as silicone is added to the receiving layer are known (for example, Japanese Patent Application Laid-Open No. 08-108636, Japanese Patent Application Laid-Open No. 2002-264543). However, these techniques cause problems such as a poor printed-article preservability and a failure in transferring the protective layer in spite of a sufficient releasability, resulting in significant difficulty in maintaining a proper balance between the releasability and the protective layer transferability when a polyester resin is used in the receiving layer.

Printers of sublimation-type thermal transfer system may be placed outdoors as an stations for outputting digital photographs, identification photographs. Therefore, image-receiving sheets are required to be superior in the releasability and the protective layer transferability even after their preservation in severe environmental conditions, such as high temperature, high temperature and high humidity, or low temperature.

SUMMARY OF THE INVENTION

The present invention is to provide a thermal transfer image-receiving sheet in which a polyester resin is used in its receiving layer, the sheet being capable of exhibiting a good releasability from a thermal transfer sheet at the time of image printing and also exhibiting a protective layer transferability balanced with the releasability.

Another object of the present invention is to provide a thermal transfer image-receiving sheet superior in environmental preservability in addition to the above-mentioned characteristics.

The present invention provides a thermal transfer image-receiving sheet which comprises a substrate sheet and a receiving layer comprising a polyester resin provided on at least one surface of the substrate sheet, wherein the receiving layer is a layer formed by applying a coating solution comprising 1 to 8% by weight of a modified silicone (I) modified with both groups of an aminoalkyl group and a polyalkylene ether group and 0.1 to 4% by weight of a curing agent based on 100 parts by weight of the polyester resin, and drying the coating solution.

DETAILED DESCRIPTION OF THE INVENTION

In order to accomplish the above objects, the present invention provides a thermal transfer image-receiving sheet which comprises a substrate sheet and a receiving layer comprising a polyester resin provided on at least one surface of the substrate sheet, wherein the receiving layer is a layer formed by applying a coating solution comprising 1 to 8% by weight of a modified silicone (I) modified with both groups of an aminoalkyl group and a polyalkylene ether group and 0.1 to 4% by weight of a curing agent based on 100 parts by weight of the polyester resin, and drying the coating solution.

The receiving layer of the thermal transfer sheet of the present invention is formed by applying a coating solution prepared by dissolving or dispersing a polyester resin together with silicone oil (I), a curing agent and other desired additives in an appropriate solvent, such as methyl ethyl ketone, toluene, xylene, ethyl acetate and acetone, or a mixed solution thereof, to a substrate sheet by conventional means such as a wire bar, a roll coater and a gravure coater, and then drying the solution. An amount of coating is normally set in a range from 1 to 6 $g/m^2$, preferably from about 2 to 4 $g/m^2$. The drying may be conducted at a temperature of 100 to 130° C. for a time of about 1 to 5 minutes. Thermal transfer image-receiving sheets of the present invention produced using a coating solution stored for a long period of time after its preparation have the same characteristics as those of thermal transfer image-receiving sheets produced using a coating solution immediately after its preparation.

With respect to the substrate sheet, various plastic films and sheets in a varying range from transparent to opaque and various kinds of paper, such as synthetic paper, quality paper , art paper, coated paper, cast-coated paper, wallpaper, backed paper, synthetic resin or emulsion impregnation-paper, synthetic plastics impregnation-paper, paper with synthetic resin added therein and paperboard, are suitably used. The thickness of the substrate sheet, which may be desirably set, is normally set approximately in a range from 130 to 250 μm.

The polyester resin, which is a constituent of the receiving layer of the thermal transfer sheet of the present invention, is a compound resulting from polycondensation of a dicarboxylic acid component (including its derivative) and a diol component (including its derivative).

As a preferable dicarboxylic acid component, a compound selected from isophthalic acid, trimellitic acid, terephthalic acid, 1,4-cyclohexane dicarboxylic acid and mixtures of two or more of them may be employed. More preferably, the dicarboxylic acid component is chosen from isophthalic acid, trimellitic acid, terephthalic acid and mixtures of two or more of them. Inclusion of an alicyclic dicarboxylic acid component is desirable from the viewpoint of improvement in light resistance.

It is desirable that the dicarboxylic acid components which are desirably used are used in the following ratios: isophthalic acid 50 to 100 mol %, trimellitic acid 0 to 1 mol %, terephthalic acid 0 to 50 mol %, 1,4-cyclohexane dicarboxylic acid 0 to 15 mol %, provided that the sum of these compounds is set to 100 mol %.

A preferable diol component(s) may be selected from ethylene glycol, polyethylene glycol, tricylcodecane dimethanol, 1,4-butane diol, bisphenol and mixtures of two or more of them. Inclusion of an alicyclic component as a diol component is desirable from the viewpoint of improvement in light resistance. Not only tricylcodecane dimethanol but also other alicyclic diol components such as cyclohexanediol, cyclohexane dimethanol, cyclohexane diethanol may be used. A preferred alicyclic diol component is tricylcodecane dimethanol.

It is desirable that the diol components which are preferably used are used in the following ratios: ethylene glycol 0 to 50 mol %, polyethylene glycol 0 to 10 mol %, tricylcodecane dimethanol 0 to 90 mol %, 1,4-butane diol 0 to 50 mol % and bisphenol A 0 to 50 mol %, provided that the sum of these compounds is set to 100 mol %.

The polyester resin employed in the present invention is a compound prepared by polycondensing at least the above-mentioned dicarboxylic acid component and diol component so that the product has a molecular weight (weight average molecular weight (Mw)) of about 11,000 or more, preferably about 15,000 or more, more preferably about 17,000 or more. If a polyester resin having a too low molecular weight is used, a receiving layer having a low elastic modulus and insufficient heat resistance is formed and it is difficult to secure a satisfactory releasability between the image-receiving sheet and a thermal transfer sheet. From the viewpoint of increasing the elastic modulus, the greater the molecular weight, the better. Therefore, although not particularly limited unless problems are raised, e.g. unless the polyester resin is insoluble in the coating solution solvent when the receiving layer is formed or unless the adherability of the receiving layer after coating and drying to the substrate sheet is affected adversely, the molecular weight is preferably set to not more than about 25,000, and to not more than about 30,000 at most. The ester resin may be prepared by using a method conventionally used.

The releasing agent is employed for the purpose of securing, with an increased certainty, the releasability between a thermal transfer sheet and an image-receiving sheet at the time of image printing. Although many kinds of releasing agent are known such as silicone oil, phosphate-based compounds and fluorine-based compounds, the present invention uses a modified silicone oil (I) modified with both groups of an aminoalkyl group and a polyalkylene ether group as a releasing agent. The use of such kind of silicone oil results in a receiving layer having well-balanced releasability and protective layer adherability and also in a receiving layer coating solution having a satisfactorily long pot life. If an amino-modified silicone or a polyalkylene-modified silicone is used alone or if the amino-modified silicone and the polyalkylene-modified silicone are used in combination, it is difficult to achieve the object of the present invention, i.e. to balance the releasability and the protective layer adherability, and the pot life of a receiving layer coating solution is insufficient.

The modified silicone oil (I) to be used in the present invention is a compound in which aminoalkyl groups and polyalkylene ether groups are substituted for a part of the methyl groups of a linear chain dimethylpolysiloxane, which is a kind of silicone oil.

Modified silicone oils represented by the following structural formula (I) are particularly preferred:

(I)

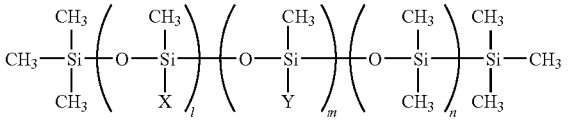

In the structural formula (I), X represents $—R^1NH_2$, wherein $R^1$ is a C1-C5 alkylene group, Y represents $—R^2(C_2H_4O)_a(C_3H_6O)_bR_3$ wherein $R_2$ represents a C1-C5 alkylene group and $R_3$ represents a C1-C5 alkyl group; a is an integer of 1 to 20; and b is an integer form 1 to 25, and l is an integer of 1 to 5; m is an integer of 1 to 5; and n is an integer of 1 to 50.

The modified silicone oil (I) of the present invention is a compound in which aminoalkyl groups and polyalkylene ether groups are substituted for a part of the methyl groups of a linear chain dimethylpolysiloxane, which is a kind of silicone oil, and it can be produced by a known method. As a product available in the market, X-22-3939A made by Shin-Etsu Chemical Co., Ltd., for example, is exemplified.

The releasing agent is used in an amount of 1 to 8% by weight, preferably 1 to 5% by weight, and more preferably 1 to 3% by weight based on 100 parts by weight of the polyester resin. If the amount to be added is too small, the receiving layer has an insufficient releasability to cause thermal fusing to a dye binder during printing; whereas if the amount to be added is too large, a protective layer may not be transferred to an image-receiving sheet.

The receiving layer of the present invention may further contain a polyether-modified silicone oil (II) and/or a phenol-modified silicone oil (III). Inclusion of such modified silicone oils improves the environmental preservability of a thermal transfer image-receiving sheet. The thermal transfer image-receiving sheet of the present invention is superior in releasabiliy and protective layer transferability even after being preserved before printing, for example, even after its preservation at high temperature and high humidity, e.g. at a temperature of 40° C. and a relative humidity of 90% for one week. The addition of the modified silicone oils (II), (III) serves to reduce the friction resistance of the surface of the receiving layer and therefore contributes, for example, to the elimination of feeding defect (double feeding) which becomes a problem when the friction resistance is strong or to the prevention of the receiving layer from abrasion injuries caused by abrasion of the surface of the receiving layer and the back surface. When the modified silicone oil (II) and/or the modified silicone oil (III) is (are) used, the preferable amount of the modified silicone oil (I) is in the range between 1 and 3% by weight.

The polyether-modified silicone oil (II) is a compound in which polyether groups is substituted for both terminal groups of linear chain dimethylpolysiloxane, which is a kind of silicone oil.

Particularly preferred is a modified silicone oil represented by the structural formula (II):

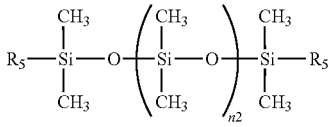

(II)

In structural formula (II), $R^5$ represents $—R^6(C_2H_4O)_c(C_3H_6O)_dH$, wherein $R_6$ represents a C1-C5 alkylene group; c is an integer of 1 to 20; and d is an integer of 1 to 20, and $n_2$ is an integer of 10 to 60.

The modified silicone oil (II) is a compound in which polyether groups are substituted for both terminal groups of a linear chain dimethylpolysiloxane, which is a kind of silicone oil. and it can be produced by a known method. As products available in the market, X-22-4274, X-22-4952, X-22-6266, made by Shin-Etsu Chemical Co., Ltd., SF8427 and BY16-004, made by Dow Corning Toray Silicone Co., Ltd., for example, are exemplified.

The phenol-modified silicone oil (III) is a compound in which phenol groups are substituted for both terminal groups of a linear chain dimethylpolysiloxane, which is a kind of silicone oil.

A modified silicone oil represented by the following structural formula (III) is particularly preferred:

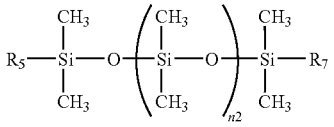

(III)

In the structural formula (III), $R_7$ is a phenol group represented by the following formula:

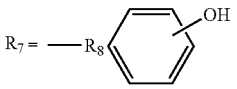

wherein $R_8$ represents a C1-C5 alkylene group, the —OH group may be at any of the o-, m- and p-positions, and $n_3$ represents an integer of 10 to 60.

The modified silicone oil (III) is a compound in which phenol groups are substituted for both terminal groups of a linear chain dimethylpolysiloxane, which is a kind of silicone oil, and it can be produced by a known method. As products available in the market, X-22-1821, made by Shin-Etsu Chemical Co., Ltd. and BY16-799, made of Dow Corning Toray Silicone Co., Ltd. are, for example, exemplified.

The modified silicone (II) and/or (III) is used approximately in an amount of 0.2 to 3% by weight, preferably 0.5 to 2% by weight based on 100 parts by weight of the polyester resin when desired. When the addition amount is too small, no effect on the improvement in preservability, especially preservability at high temperature and high humidity can be attained, and frictional resistance becomes high and defective feeding (double feeding) can not be prevented. When the addition amount is too large, the protective layer does not transfer to the image-receiving sheet.

The curing agent allows polyester to react with active hydrogen therein to crosslink and cure a polyester resin so that a heat-resistant property is imparted to the receiving layer. As the curing agent, isocyanate and chelate compounds or the like may be used. The curing agent also has an action of fixing the releasing agent in the receiving layer by reacting with the modified silicones. Moreover, it has an action of preventing the releasing agent from bleeding to the surface. An isocyanate compound of non-yellowing type is preferably used as the curing agent.

Specific examples thereof include xylene diisocyanate (XDI), hydrogenated XDI, isophrone diisocyanate (IPDI), hexamethylene diisocyanate (HDI), and adduct forms/burette forms, oligomers and prepolymers thereof. In addition to these, isocyanate compounds of non-yellowing type which react within a period of time required for drying the solvent of the receiving layer coating solution may be used.

The curing agent is used approximately in an amount of 0.1 to 4% by weight, preferably 0.1 to 1.5% by weigh based on 100 parts by weight of the polyester resin. If the amount thereof is too small, the receiving layer has an insufficient releasability to cause thermal fusing to a dye binder during printing; whereas if the amount thereof is too large, the adherability to a protective layer is deteriorated.

A catalyst may be added as a reaction assistant of the isocyanate compound, and any of known catalysts may be used. One example of typical catalysts is di-n-butyl tin dilaurate (DBTDL), which is a tin-based catalyst. In addition to this, dibutyl tin fatty acid salt-based catalysts, monobutyl tin fatty acid salt-based catalysts, dioctyl tin fatty acid salt-based catalysts, monooctyl tin fatty acid salt-based catalysts and their dimers or the like may be effectively used. Because the reaction rate becomes greater as the amount of tin per weight becomes greater, the kind, combination and amount of addition thereof are properly selected in accordance with the isocyanate compound to be used. In the case when a block type isocyanate compound is used, a block dissociation catalyst may be effectively used in combination.

With respect to the thermal transfer image-receiving sheet of the present invention, additional layers, such as an antistatic layer, a cushion layer and an intermediate layer containing a white pigment and a fluorescent whitening agent, may be formed between the substrate sheet and the image-receiving sheet, if necessary. A layer such as an antistatic layer, a writing layer and an ink-jet receiving layer may be formed on the surface of the substrate sheet on the side opposite to the receiving layer.

With respect to a thermal transfer sheet for use in thermal transfer using the thermal transfer image-receiving sheet of the present invention, conventional thermal transfer sheets may be used that comprise a dye layer which contains sublimation-type dye and is formed on paper, polyester film or the like. The effects of the present invention can be enjoyed most effectively when the thermal transfer image-receiving sheet of the present invention is used in combination with a thermal transfer sheet having a dye ink layer comprising a polyacetal resin (especially, acetal resin) as a binder resin.

The present invention is illustrated by way of Examples below. In the Examples, "part(s)" means "part(s) by weight" unless otherwise stated.

EXAMPLES

Examples A-1 to A-5

As a substrate sheet, synthetic paper YUPO FPG#150 (made by Oji-Yuka Synthetic Paper Co., Ltd.) of 150 μm in thickness was used. An image-receiving sheet of the present invention was prepared by applying a receiving layer coating solution having a composition which is shown in the following Table A-1 and which comprises polyester resin 1, modified silicone (I), a curing agent, a catalyst and a toluene/ketone mixed solvent to one surface of the substrate sheet using a wire bar at a rate so as to weigh 5.0 g/m$^2$ after drying, and then drying the solution at 115° C. for 2 minutes. Using a coating solution immediately after its preparation, a coating solution after 3 hours from its preparation, a coating solution after 6 hours from its preparation and a coating solution after 8 hours from its preparation, four image-receiving sheets were produced in the respective example.

Example A-6

As a substrate sheet, synthetic paper YUPO FPG#150 (made by Oji-Yuka Synthetic Paper Co., Ltd.) of 150 μm in thickness was used. An image-receiving sheet of the present invention was prepared by applying a receiving layer coating solution having a composition which is shown in the following Table A-1 and which comprises polyester resin 2, modified silicone (I), a curing agent, a catalyst and a toluene/ketone mixed solvent to one surface of the substrate sheet using a wire bar at a rate so as to weigh 5.0 g/m$^2$ after drying, and then drying the solution at 115° C. for 2 minutes. Using a coating solution immediately after its preparation, a coating solution after 3 hours from its preparation, a coating solution after 6 hours from its preparation and a coating solution after 8 hours from its preparation, four image-receiving sheets were produced in the respective example.

TABLE A-1

| | | Example | | | | | |
|---|---|---|---|---|---|---|---|
| | | A-1 | A-2 | A-3 | A-4 | A-5 | A-6 |
| amount of modified silicone (I) | solids | 2% | 2% | 2% | 5% | 5% | 2% |
| amount of curing agent | | 0.1% | 0.5% | 1.0% | 0.1% | 0.5% | 1.0% |
| polyester resin 1 | 30% | 100 | 100 | 100 | 100 | 100 | — |
| polyester resin 2 | 30% | — | — | — | — | — | 100 |
| modified silicone (I) | 100% | 0.6 | 0.6 | 0.6 | 1.5 | 1.5 | 0.6 |
| curing agent | 40% | 0.075 | 0.375 | 0.75 | 0.075 | 0.375 | 0.75 |
| catalyst | 100% | 0.1 | 0.1 | 0.1 | 0.1 | 0.1 | 0.1 |
| ketone/toluene = 1/1 | 0% | 50 | 50 | 50 | 50 | 50 | 50 |

In Table A-1, the polyester resin 1 is Vylon 290 made by Toyobo Co., Ltd. The polyester resin A-2 is Vylon 700 made by Toyobo Co., Ltd. The modified silicone (I) is X-22-3939A (a silicone oil modified with an aminoalkyl group and a polyalkylene ether group, made by Shin-Etsu Chemical Co., Ltd.). The curing agent is Takenate A-14 (xylene diisocyanate, made by Mitsui Takeda Chemicals, Inc.). The catalyst is CAT-SBL (dibutyl tin compound, made by Sankyo Organic Chemicals Co., Ltd.).

The amounts of the modified silicone oil (I) added is the amount (solids conversion) (% by weight) added to 100 parts by weight of the polyester resin.

The amount of the curing agent added is the amount (solids conversion) (% by weigh) added to 100 parts by weight of the polyester resin.

The amount of the catalyst added is the amount (solids conversion) (% by weigh) added to 100 parts by weight of the polyester resin.

Comparative Examples A-1 to A-3

As a substrate sheet, synthetic paper YUPO FPG#150 (made by Oji-Yuka Synthetic Paper Co., Ltd.) of 150 μm in thickness was used. An image-receiving sheet of the present invention was prepared by applying a receiving layer coating solution having a composition which is shown in the following Table A-2 and which comprises polyester resin 1, modified silicone 2, modified silicone 3, a curing agent, a catalyst and a toluene/ketone mixed solvent to one surface of the substrate sheet using a wire bar at a rate so as to weigh 5.0 g/m$^2$ after drying, and then drying the liquid at 115° C. for 2 minutes. Using a coating solution immediately after its preparation, a coating solution after 3 hours from its preparation, a coating solution after 6 hours from its preparation and a coating solution after 8 hours from its preparation, four image-receiving sheets were produced in each of Comparative Examples.

TABLE A-2

| | | Comparative Example | | |
|---|---|---|---|---|
| | | A-1 | A-2 | A-3 |
| amount of modified silicone | solids | 2% | 2% | 2% |
| amount of curing agent | | 1% | 1% | 1% |
| polyester resin 1 | 30% | 100 | 100 | 100 |
| modified silicone 2 | 100% | 0.6 | — | 0.3 |
| modified silicone 3 | 100% | — | 0.6 | 0.3 |
| curing agent | 40% | 0.75 | 0.75 | 0.75 |
| catalyst | 100% | 0.1 | 0.1 | 2 |
| ketone/toluene = 1/1 | 0% | 50 | 50 | 49 |

In Table A-2, the polyester resin 1 is Vylon 290 made by Toyobo Co., Ltd. The modified silicone 2 is X-22-6266 (polyether group-modified silicone oil, made by Shin-Etsu Chemical Co., Ltd.). The modified silicone oil 3 is KF-393 (aminoalkyl group-modified silicone oil, made by Shin-Etsu Chemical Co., Ltd.). The curing agent is Takenate A-14 (xylene diisocyanate, made by Mitsui Takeda Chemicals, Inc.). The catalyst is CAT-SBL (dioctyl tin compound, made by Sankyo Organic Chemicals Co., Ltd.).

The amounts of the modified silicone 2 and the modified silicone 3 added are respectively the amount (solids conversion) (% by weight) added based on 100 parts by weight of the polyester resin.

The amount of the curing agent added is the amount (solids conversion) (% by weight) added based on 100 parts by weight of the polyester resin.

The amount of the catalyst added is the amount (solids conversion) (% by weight) added based on 100 parts by weight of the polyester resin.

(Evaluation)

The protective layer adhesiveness (OP adhesiveness) and the releasing property were evaluated using CP-100 (made by Canon Inc.) as an evaluation printer and a standard ribbon for CP-100 as an evaluation ribbon. The results are summarized in Table A-3.

TABLE A-3

| | coating solution immediately after prepared | | after 3 hours | | after 6 hours | | after 8 hours | |
|---|---|---|---|---|---|---|---|---|
| | releasing property | protective layer adhesiveness | releasing property | protective layer adhesiveness | releasing property | protective layer adhesiveness | releasing property | protective layer adhesiveness |
| Example A-1 | 4 | OK | 4 | OK | 4 | OK | 4 | OK |
| Example A-2 | 4 | OK | 4 | OK | 4 | OK | 4 | OK |
| Example A-3 | 4 | OK | 4 | OK | 4 | OK | 4 | OK |
| Example A-4 | 4 | OK | 4 | OK | 4 | OK | 4 | OK |
| Example A-5 | 4 | OK | 4 | OK | 4 | OK | 4 | OK |
| Example A-6 | 4 | OK | 4 | OK | 4 | OK | 4 | OK |
| Comparative Example A-1 | 3 | OK | 2 | OK | 2 | OK | 2 | OK |
| Comparative Example A-2 | 4 | NG | 2 | OK | 1 | OK | 1 | OK |
| Comparative Example A-3 | 4 | NG | 3 | OK | 1 | OK | 1 | OK |

Protective Layer Adhesiveness: White a solid image was printed using a CP-100 and then visual evaluation was conducted according to the following criteria:

OK: No peeling occurred when applied by a mending tape.

NG: Peeling occurred when applied by a mending tape.

Releasability: After 5 sheets of a black solid image were printed continuously using CP-100, the printed articles were visually evaluated and ranked as follows:

4: No problem.

3: Abnormal transfer occurred very slightly.

2: Three-color printing was possible, but abnormal transfer occurred frequently.

1: Abnormal transfer was observed in most area.

Example B-1

As a substrate sheet, synthetic paper YUPO FPG#150 (made by Oji-Yuka Synthetic Paper Co., Ltd.) of 150 μm in thickness was used. An image-receiving sheet of the present invention was prepared by applying a receiving layer coating solution having a composition which is shown in the following Table B-1 and which comprises polyester resin 1, modified silicone (I), modified silicone (II), a curing agent, a catalyst and a toluene/ketone mixed solvent to one surface of the substrate sheet using a wire bar at a rate so as to weigh 5.0 g/m$^2$ after drying, and then drying the solution at 115° C. for 2 minutes. Using a coating solution immediately after its preparation, a coating solution after 6 hours from its preparation or a coating solution after 8 hours from its preparation, three image-receiving sheets were produced.

TABLE B-1

| | | Example B-1 |
|---|---|---|
| amount of silicone (I) | solids | 1.50% |
| amount of silicone (II) | | 0.50% |
| amount of curing agent | | 1% |
| polyester resin 1 | 30% | 20 parts |
| modified silicone (I) | 100% | 0.09 parts |
| modified silicone (II) | 100% | 0.03 parts |
| curing agent | 100% | 0.06 parts |

TABLE B-1-continued

| | | Example B-1 |
|---|---|---|
| catalyst | 100% | 0.02 parts |
| ketone/toluene = 1/1 | 0% | 12 parts |

In Table B-1, the polyester resin 1 is Vylon 290 made by Toyobo Co., Ltd. The modified silicone (I) is X-22-3939A (a silicone oil modified with an aminoalkyl group and a polyalkylene ether group, made by Shin-Etsu Chemical Co., Ltd.). The modified silicone (II) is X-22-6266 (a polyether-modified silicone oil, made by Shin-Etsu Chemical Co., Ltd.). The curing agent is Takenate A-65 (hexamethylene diisocyanate, made by Mitsui Takeda Chemicals, Inc.). The catalyst is S-CAT52A (dioctyl tin compound, made by Sankyo Organic Chemicals Co., Ltd.).

The amounts of the modified silicone oils (I) and (II) added are the amounts (solids conversion) (% by weight) of them added to 100 parts by weight of the polyester resin. The amount of the curing agent added is the amount (solids conversion) (% by weigh) of that added to 100 parts by weight of the polyester resin.

(Evaluation)

The protective layer adhesiveness (OP adhesiveness) and the releasing property were evaluated using CP-100 (made by Canon Inc.) as an evaluation printer and a standard ribbon for CP-100 as an evaluation ribbon. The results are summarized in Table B-2.

TABLE B-2

| | coating solution immediately after prepared | | coating solution 6 hours after prepared | | coating solution 8 hours after prepared | |
|---|---|---|---|---|---|---|
| | releasing property abnormal transfer | protective layer adhesiveness | releasing property abnormal transfer | protective layer adhesiveness | releasing property abnormal transfer | protective layer adhesiveness |
| Example B-1 | 4 | OK | 4 | OK | 4 | OK |

Protective Layer Adhesiveness: White a solid image was printed using a CP-100 and then visual evaluation was conducted according to the following criteria:

OK: No peeling occurred when applied by a mending tape.

NG: Peeling occurred when applied by a mending tape.

Releasability: After 5 sheets of a black solid image were printed continuously using CP-100, the printed articles were visually evaluated and ranked as follows:

4: No problem.

3: Abnormal transfer occurred very slightly.

2: Three-color printing was possible, but abnormal transfer occurred frequently.

1: Abnormal transfer*) was observed in most area.

*) Abnormal Transfer is a defective phenomenon in which a thermal transfer sheet and an image-receiving sheet are thermally fused during printing and the dye is transferred together with the binder.

Environmental Preservability: The protective layer adherability was evaluated after a one-week preservation at a temperature of 60° C. and a humidity of 30%, after a one-week preservation at a temperature of 40° C. and a humidity of 90%, and after a one-week preservation at a temperature of 5° C. of an image-receiving sheet prepared using a coating solution immediately after its preparation. The results are shown in Table B-3.

TABLE B-3

| | change on time (protective layer adhesiveness) | | | | friction | |
|---|---|---|---|---|---|---|
| | non preserved | 60° C. 30% one week | 40° C. 90% one week | 5° C. one week | coefficient (room temp.) | abrasion resistance |
| Example B-1 | OK | OK | OK | OK | 0.1 | OK |

Coefficient of Friction: The dynamic coefficient of friction of a surface of an image-receiving sheet produced by using a coating solution immediately after its preparation was measured according to the standards of JIS P 8147 and was found to be a low value of 0.1.

Abrasion Resistance: The abrasion resistance means a characteristic regarding the resistance of a receiving layer to abrasion injuries caused by abrasion between an image-receiving sheet and a back surface. Two image-receiving sheets were superposed so that the receiving layer of one sheet was put on the back surface of the other sheet and the sheets were reciprocatingly rubbed together ten times under a load of 1 kg. The image-receiving sheet having the rubbed receiving layer was subjected to black solid printing using CP-100 and was visually checked whether it was printed normally or not. The abrasion resistance of a sheet was ranked as follows:

OK: No abnormal transfer occurred.

NG: Abnormal transfer occurred.

Example B-2

As a substrate sheet, synthetic paper YUPO FPG#150 (made by Oji-Yuka Synthetic Paper Co., Ltd.) of 150 μm in thickness was used. An image-receiving sheet of the present invention was prepared by applying a receiving layer coating solution having a composition which is shown in Table B-4 and which comprises polyester resin 1, modified silicone (I), modified silicone (II), a curing agent, a catalyst and a toluene/ketone mixed solvent to one surface of the substrate sheet using a wire bar at a rate so as to weigh 5.0 g/m$^2$ after drying, and then drying the solution at 115° C. for 2 minutes. Using a coating solution immediately after its preparation, a coating solution after 6 hours from its preparation or a coating solution after 8 hours from its preparation, three image-receiving sheets were produced.

TABLE B-4

| | | Example B-2 |
|---|---|---|
| amount of modified silicone (I) | solids | 2.0% |
| amount of modified silicone (II) | | 0.5% |
| amount of curing agent | | 1.0% |
| polyester resin1 | 30% | 20 parts |
| modified silicone (I) | 100% | 0.12 parts |
| modified silicone (II) | 100% | 0.03 parts |
| curing agent | 100% | 0.06 parts |
| catalyst | 100% | 0.02 parts |
| ketone/toluene = 1/1 | 0% | 12 parts |

In Table B-4, the polyester resin 1 is Vylon 290 made by Toyobo Co., Ltd. The modified silicone (I) is X-22-3939A (silicone oil modified with an aminoalkyl group and a polyalkylene ether group, made by Shin-Etsu Chemical Co., Ltd.). The modified silicone (II) is X-22-1821 (phenol-modified silicone oil, made by Shin-Etsu Chemical Co., Ltd.). The curing agent is Takenate A-65 (hexamethylene diisocyanate, made by Mitsui Takeda Chemicals, Inc.). The catalyst is S-CAT52A (dioctyl tin compound, made by Sankyo Organic Chemicals Co., Ltd.).

(Evaluation)

The image-receiving sheet obtained was evaluated for its protective layer adherability (OP adherability), releasability, environmental preservability, coefficient of friction and abrasion resistance in the same ways as in Example B-1. The results are shown in the following Tables B-5 and B-6.

TABLE B-5

| | coating solution immediately after prepared | | coating solution 6 hours after prepared | | coating solution 8 hours after prepared | |
|---|---|---|---|---|---|---|
| | releasing property | protective layer adhesiveness | releasing property | protective layer adhesiveness | releasing property | protective layer adhesiveness |
| Example B-2 | 4 | OK | 4 | OK | 4 | OK |

TABLE B-6

| | change on time (protective layer adhesiveness) | | | | | |
|---|---|---|---|---|---|---|
| | non preserved | 60° C. one week | 40° C. 90% one week | 5° C. one week | friction coefficient (room temp.) | abrasion resistance |
| Example B-2 | OK | OK | OK | OK | 0.1 | OK |

Comparative Examples B-1 to B-3

As a substrate sheet, synthetic paper YUPO FPG#150 (made by Oji-Yuka Synthetic Paper Co., Ltd.) of 150 μm in thickness was used. An image-receiving sheet of the present invention was prepared by applying a receiving layer coating solution having a composition which is shown in the following Table B-7 and which comprises polyester resin 1, modified silicone 2, modified silicone 3, a curing agent, a catalyst and a toluene/ketone mixed solvent to one surface of the substrate sheet using a wire bar at a rate so as to weigh 5.0 g/m$^2$ after drying, and then drying the liquid at 115° C. for 2 minutes. Using a coating solution immediately after its preparation, a coating solution after 6 hours from its preparation or a coating solution after 8 hours from its preparation, three image-receiving sheets were produced in each of Comparative Examples.

TABLE B-7

| | | Comparative Example | | |
|---|---|---|---|---|
| | | B-1 | B-2 | B-3 |
| amount of modified silicone | solids | 2% | 2% | 2% |
| amount of curing agent | | 1% | 1% | 1% |
| polyester resin 1 | 30% | 100 parts | 100 parts | 100 parts |
| modified silicone 2 | 100% | 0.6 parts | — | 0.3 parts |
| modified silicone 3 | 100% | — | 0.6 parts | 0.3 parts |
| curing agent | 100% | 0.3 parts | 0.3 parts | 0.3 parts |
| catalyst | 100% | 0.1 parts | 0.1 parts | 0.1 parts |
| ketone/toluene = 1/1 | 0% | 50 parts | 50 parts | 49 parts |

In Table B-7, the polyester resin 1 is Vylon 290 made by Toyobo Co., Ltd. The modified silicone 2 is X-22-6266 (polyether group-modified silicone oil, made by Shin-Etsu Chemical Co., Ltd.). The modified silicone oil 3 is KF-393 (aminoalkyl group-modified silicone oil, made by Shin-Etsu Chemical Co., Ltd.). The curing agent is Takenate A-65 (hexamethylene diisocyanate, made by Mitsui Takeda Chemicals, Inc.). The catalyst is S-CAT52A (dioctyl tin compound, made by Sankyo Organic Chemicals Co., Ltd.).

The amounts of the modified silicone 2 and the modified silicone 3 added are respectively the amount (solids conversion) (% by weight) added based on 100 parts by weight of the polyester resin.

The amount of the curing agent added is the amount (solids conversion) (% by weight) added based on 100 parts by weight of the polyester resin.

Evaluation

The image-receiving sheet obtained was evaluated for its protective layer adherability (OP adherability), releasability, environmental preservability, coefficient of friction and abrasion resistance in the same ways as in Example B-1. The results are shown in the following Tables B-8 and B-9.

TABLE B-8

| | coating solution immediately after prepared | | after 3 hours | | after 6 hours | | after 8 hours | |
|---|---|---|---|---|---|---|---|---|
| | releasing property | protective layer adhesiveness | releasing property | protective layer adhesiveness | releasing property | protective layer adhesiveness | releasing property | protective layer adhesiveness |
| Comparative Example B-1 | 3 | OK | 2 | OK | 2 | OK | 2 | OK |
| Comparative Example B-2 | 4 | NG | 2 | OK | 1 | OK | 1 | OK |
| Comparative Example B-3 | 4 | NG | 3 | OK | 1 | OK | 1 | OK |

TABLE B-9

| | change on time (protective layer adhesiveness) | | | | | |
|---|---|---|---|---|---|---|
| | non preserved | 60° C. one week | 40° C. 90% one week | 5° C. one week | friction coefficient (room temp.) | abrasion resistance |
| Comparative Example B-1 | OK | NG | NG | OK | 0.1 | OK |
| Comparative Example B-2 | NG | NG | NG | NG | 0.3 | NG |
| Comparative Example B-3 | NG | NG | NG | NG | 0.1 | OK |

What is claimed is:

1. A thermal transfer image-receiving sheet which comprises a substrate sheet and a receiving layer comprising a polyester resin provided on at least one surface of the substrate sheet, wherein the receiving layer is a layer formed by applying a coating solution comprising 1 to 8% by weight of a modified silicone oil (I) modified with both groups of an aminoalkyl group and a polyalkylene ether group and 0.1 to 4% by weight of a curing agent based on 100 parts by weight of the polyester resin, and drying the coating solution; wherein the modified silicone oil (I) is represented by the following structural formula (I):

(I)

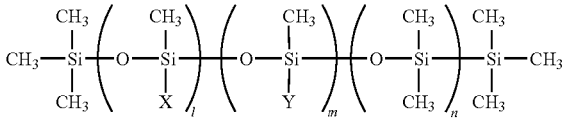

wherein X represents —$R^1NH^2$ and $R^1$ is a C1-C5 alkylene group; Y represents —$R^2(C_2H_4O)_a(C_3H_6O)_bR_3$ wherein $R^2$ represents a C1-C5 alkylene group and $R_3$ represents a C1-C5 alkyl group; a is an integer of 1 to 20; b is an integer from 1 to 25; 1 is an integer of 1 to 5; m is an integer of 1 to 5; and n is an integer of 1 to 50.

2. The thermal transfer image-receiving sheet according to claim 1, wherein the modified silicone oil (I) is contained in an amount of 1 to 5% by weight based on the polyester resin.

3. The thermal transfer image-receiving sheet according to claim 1, wherein the curing agent is contained in an amount of 0.1 to 1.5% by weight based on the polyester resin.

4. The thermal transfer image-receiving sheet according to claim 1, wherein the polyester resin has a weight average molecular weight in the range between 17,000 and 25,000.

5. A thermal transfer image-receiving sheet which comprises a substrate sheet and a receiving layer comprising a polyester resin provided on at least one surface of the substrate sheet, wherein the receiving layer is a layer formed by applying a coating solution comprising 1 to 8% by weight of a modified silicone oil (I) modified with both groups of an aminoalkyl group and a polyalkylene ether group, and further comprising 0.2 to 3% by weight of a polyether-modified silicone oil (II) and/or phenol-modified silicone oil (III), and 0.1 to 4% by weight of a curing agent based on 100 parts by weight of the polyester resin, and drying the coating solution wherein the modified silicone oil (I) is represented by the following structural formula (I):

(I)

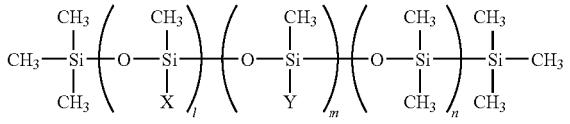

wherein X represents —$R^1NH_2$ and $R^1$ is a C1-C5 alkylene group; Y represents —$R^2(C_2H_4O)_a(C_3H_6O)_bR_3$, wherein $R_2$ represents a C1-C5 alkylene group and $R_3$ represents a C1-C5 alkyl group; a is an integer of 1 to 20, b is an integer from 1 to 25; 1 is an integer of 1 to 5; m is an integer of 1 to 5, and n is an integer of 1 to 50.

6. The thermal transfer image-receiving sheet according to claim 5, wherein the polyether-modified silicone oil (ii) is represented by the structural formula (II):

(II)

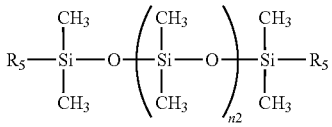

wherein $R^5$ represents —$R^6(C_2H_4O)_c(C_3H_6O)_dH$, and $R^6$ represents a C1-C5 alkylene group; c is an integer of 1 to 20, d is an integer of 1 to 20, and $n_2$ is an integer of 10 to 60.

7. The thermal transfer image-receiving sheet according to claim 5, wherein the phenol-modified silicone oil (III) is represented by the following structural formula (III):

(III)

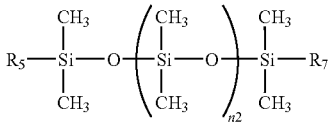

wherein $R_7$ is a phenol group represented by the following formula:

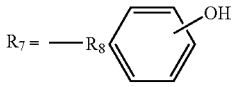

wherein $R_8$ represents a C1-C5 alkylene group, the —OH group may be at any of the o-, m- and p-positions; and $n_3$ represents an integer of 10 to 60.

8. The thermal transfer image-receiving sheet according to claim 5, wherein the modified silicone oil (I) is contained in an amount of 1 to 3% by weight based on the polyester resin.

9. The thermal transfer image-receiving sheet according to claim 5, wherein the modified silicone oil (II) is contained in an amount of 0.5 to 2% by weight based on the polyester resin.

10. The thermal transfer image-receiving sheet according to claim 6, wherein the curing agent is contained in an amount of 0.1 to 1.5% by weight based on the polyester resin.

11. The thermal transfer image-receiving sheet according to claim 5, wherein the polyester resin has a weight average molecular weight in the range between 17,000 and 25,000.

* * * * *